United States Patent [19]

Domovs et al.

[11] Patent Number: 4,713,848

[45] Date of Patent: Dec. 22, 1987

[54] HYGIENIC WHEELCHAIR SEAT FOR EXTENDED USE

[75] Inventors: Jean R. Domovs, 22 Dayton Rd., Morris Plains, N.J. 07950; Willard H. Rice, Meridith, N.H.

[73] Assignee: Jean R. Domovs, Morris Plains, N.J.

[21] Appl. No.: 886,359

[22] Filed: Jul. 16, 1986

[51] Int. Cl.[4] ..... A47K 11/06

[52] U.S. Cl. ..... 4/480; 4/471; 280/289 WC

[58] Field of Search ..... 4/480, 449, 464, 465, 4/466, 467, 471, 472, 479, 483; 5/90; 297/DIG. 4; 280/242 WC, 289 WC

[56] References Cited

U.S. PATENT DOCUMENTS

| | | | |
|---|---|---|---|
| 341,135 | 5/1986 | Ellison . | |
| 467,017 | 1/1892 | Olsen | 4/480 |
| 557,614 | 4/1896 | Schmitt | 4/480 |
| 601,312 | 3/1898 | Beall . | |
| 1,224,478 | 5/1917 | McNeil | 5/90 |
| 1,294,747 | 2/1919 | Zabawa . | |
| 1,691,620 | 11/1928 | Wilson . | |
| 2,880,783 | 4/1959 | Schwinn . | |
| 3,158,398 | 11/1964 | Stryker . | |
| 3,245,090 | 4/1966 | Slimmer . | |
| 3,271,785 | 9/1966 | Du Bose | 4/480 |
| 3,568,219 | 3/1971 | Roberts . | |
| 3,668,720 | 6/1972 | Wetzler | 5/90 |
| 3,863,276 | 2/1975 | Agnew . | |
| 4,048,679 | 9/1977 | Garnett . | |
| 4,296,506 | 10/1981 | Stoute . | |

*Primary Examiner*—Henry J. Recla
*Assistant Examiner*—Linda J. Sholl
*Attorney, Agent, or Firm*—Bruce M. Collins

[57] ABSTRACT

A wheelchair seat for placement in a foldable wheelchair frame in which a rigid, substantially flat seat base operable to be received by a wheelchair frame has an elongated opening coaxial with the major axis of the perineum of a person when normally seated on the seat base and of such minimal dimensions as to permit the normally free passage of excretions through the opening without detracting from the support provided by the seat base; an elongated arm member pivotably mounted on the underside of the seat base for rotation about an axis perpendicular to its major plane; an elongated gate of a length and a width sufficient to occlude the opening, a gate stop disposed on the bottom of the seat base; and a removable waste receptacle support disposed on the seat base beneath the opening.

8 Claims, 4 Drawing Figures

HYGIENIC WHEELCHAIR SEAT FOR EXTENDED USE

BACKGROUND OF THE INVENTION

Individuals confined to a wheelchair by reason of injury or disease still must cope with normal excretory functions, a dilemma faced by both the alert homebound patient and the institutionalized patient. The person must be positioned or moved to a toilet or commode seat, an operation requiring one or two attendants. This is particularly true for a person who is unable to stand, such as one who is paralyzed by reason of spinal injury or who suffers from a condition such as multiple sclerosis.

A number of solutions to this problem have been proposed, including various "commode chairs" or "invalid chairs". See, for example, U.S. Pat. Nos. 341,135 to Ellison; 557,614 to Schmitt; 601,312 to Beall; 1,691,620 to Wilson; 3,245,090 to Slimmer; 3,271,785 to Du Bose; 2,880,783 to Schwinn; 3,158,398 to Stryker; and 4,296,506 to Stoute et al.

These previous proposals have required (i) a specially designed commode, (ii) the movement of the patient to another chair or commode, or (iii) the repositioning, generally involving lifting, of the patient to permit introduction into the wheelchair of a specialized seat or container. These previous proposals have proven to be less than satisfactory in that the structures are designed as commodes rather than wheelchair seats and fail to provide the requisite support for a patient in long-term use. As a result, common practice often involves nothing more than the use of the conventional bedpan, or simply ignoring the patient who then unavoidable soils clothing, wheelchair, and floor. Moreover, none of these prior devices, with the exception of that of Stoute et al., is suitable for the foldable wheelchairs now so widely in use. Stoute et al. describe an invalid chair having a flexible padded seat with a generally rectangular opening defined therein and a wastereceiving receptacle disposed below it. While Stoute et al.'s device is a major advance, its flexible seat provides inadequate support for a patient who spends long periods of time in the wheelchair. Moreover, the Stoute et al. device requires a relatively high degree of dexterity to attend to and complete the manipulations involved in removing the container and closing the flap of the Stoute et al. device.

DETAILED DESCRIPTION

The present invention pertains to a wheelchair seat intended to be utilized in a conventional foldable wheelchair frame and to permit the patient to attend to his or her normal excretory functions in a hygienically desirable fashion. This is possible without the need for lifting the patient from the chair or moving the patient to a commode or toilet. By reason of its construction and design, moreover, the present device is suitable for use as a conventional supporting wheelchair seat over long periods of time by a patient. In addition, the device permits a patient having only minimal arm mobility to utilize the waste receiving features of the device without assistance and then remain on the seat of the wheelchair in his or her normal position but under improved hygienic conditions until assistance in disposing of the waste can be provided.

Figure 1:
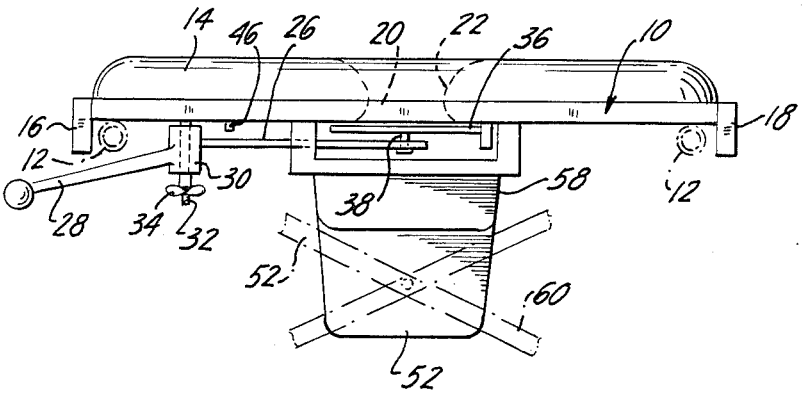
FIG. 1 is a front elevation of the wheelchair seat.

With reference to the drawings, the invention utilizes a rigid, substantially flat seat base 10 operable to be received by a wheelchair frame, the horizontal side support bars of which are shown as 12. Seat base 10, which replaces the conventional flexible seat of a foldable wheelchair, is operable to support a person thereon in a seated position and may be provided with cushion 14 fabricated out of a suitable material such as foam rubber, a pliable gel, a fluid-filled bladder, or the like.

Seat base 10 is provided with wheelchair frame engaging means 16 and 18 (16 being shown in partial cutaway in FIG. 3 for the sake of clarity of the remaining structure) which means are operable to retain the base on the opened frame of foldable wheelchair. The frame engaging means can be disposed on seat base 10 to engage the outside of the wheelchair frame, as shown, or can be disposed inwardly so as to engage the inside of the frame. Other structures can be employed, this component merely connecting the overall structure to a conventional wheelchair frame. Thus although more involved structures can be used for the frame engaging means, including more or less permanent fasteners, the depicted pair of downwardly disposed bars 16 and 18 have proven to be fully satisfactory.

Seat base 10 has an elongated aperture 20 defined therein so as to be substantially coaxial with the major axis of the perineum of a person when normally seated on the seat base. The width of the aperture is selected so as to be minimal, permitting the normally free passage of urinary and fecal excretions through the aperture without substantially detracting from the support provided by seat base and cushion 14. This minimal width is critical to the success of the seat for long-time use since the customary dimensions of the aperture of a "commode" adapted for a wheelchair provide inadequate support for a person seated thereon for any significant period of time. The length of aperture 20, on the other hand, must be greater than the normal distance between the rectum and the urinary organ of the patient, both male and female. In practice, therefore, and considering the available depth provided by the conventional foldable wheelchair frame for a seat, the length of aperture 20 generally will be equal to at least about 50%, and preferably about 60%, of the normal depth provided by the wheelchair frame for a seat, leaving from 40% to 50% of that depth to be divided between each of the front and back of the seat and the aperture. The average width of aperture 20, in contrast, will be about one quarter of its length. The elongated aperture may be slightly enlarged at its rear to facilitate passage of fecal matter.

Seat base 10 can be fitted with cushion 14 which will be of substantially the same configuration (when viewed from the top) as seat base 10. Cushion 14 can be detachably joined to seat base 10 by any conventional means (not shown) such as snaps, tie strings, Velcro material, or the like, in order to permit repair, replacement or cleaning, and will define a complementing elongated aperture 22 which is aligned with elongated aperture 20 in seat base 10.

An elongated arm member 24 (most clearly seen in its entirety in FIG. 4) is pivotably mounted on the underside of seat base 10 for rotation about an axis perpendicular to the major plane of seat base 10. Arm member 24 has a first end portion 26, a second end portion 28, and an intermediate collar portion 30. Intermediate collar portion 30 is aligned transversely to the major axis of arm member 24, generally but not necessarily perpendicular to that major axis. Second end portion 28 of arm member 24 comprises a handle which extends beyond seat base 10 and which is used to effect rotation of the arm member. The orientation of first end portion 26 and second end portion 28 to collar 30 need not, and generally will not, be linear. As shown, the alignment can be such that first end portion 26 moves in a plane parallel to that of the major plane of seat base 10 while second end portion 28 is angled down from this plane. The handle end of second end portion 28 of arm member 24 can be oriented so as to extend beyond the front or the side of the wheelchair for movement by the person seated therein or otherwise by an attendant.

A shaft 32, which receives collar portion 30 of arm 26, is disposed on the underside of seat base 10. Removable fastener means 34 (shown in FIGS. 1, 2 and 3 but removed in FIG. 4) engage shaft 32 and retain arm member 24 on the shaft for rotational movement, thereby permitting removal of arm member 24 and its associated structure for cleaning, replacement, or temporary non-use in an environment in which it is deemed unnecessary. When arm member 24 is retained on shaft 32 by fastener means 34, however, and upon rotation of arm member 24 about shaft 32 (by movement of the second end portion 28), first end portion 26 will pass across and under elongated aperture 20 in seat base 10.

An elongated gate 36 of a length and a width sufficient to occlude the entirety of elongated aperture 20 is rotatably mounted on first end portion 26 of elongated arm member 24 through bearing 38 at approximately the midpoint of the lower surface of elongated gate 36 and at a point on first end portion 26 of arm 24 which passes across and under aperture 20. Elongated gate 36 preferably has parallel sides along its longest dimension, with a substantially smooth, readily cleanable, planar upper surface. The end portions of the elongated gate 36 can be straight (as shown) or curved.

Figure 2:
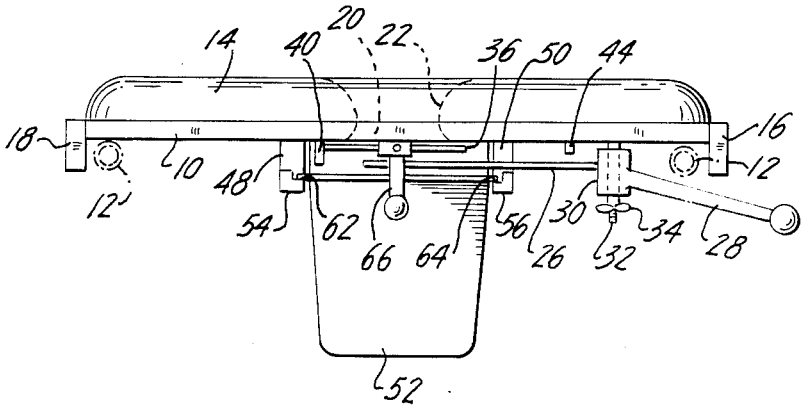
FIG. 2 is a rear elevation of the wheelchair seat shown in FIG. 1.
Figure 4:
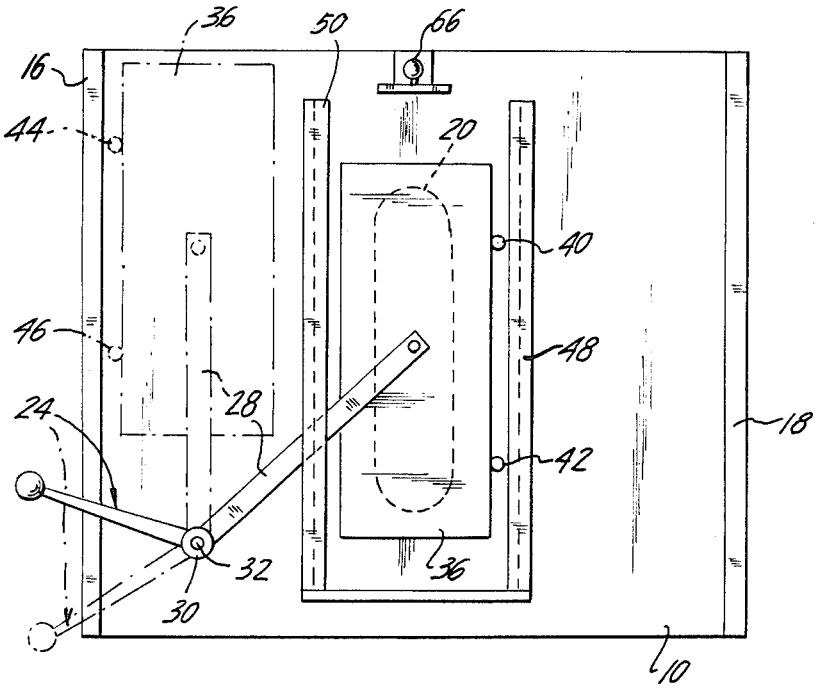
FIG. 4 is plan view of the bottom of the wheelchair seat shown in FIGS. 1, 2 and 3.
Figure 3:
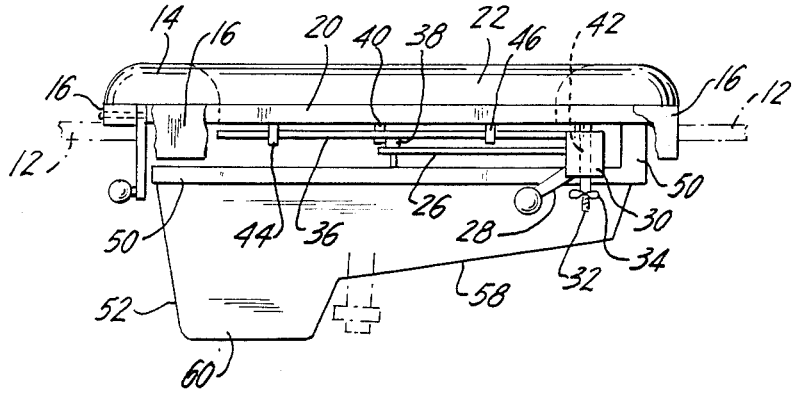
FIG. 3 is a side view of the wheelchair seat shown in FIGS. 1 and 2.

First stop means are disposed on the bottom of seat base 10 and are operable upon rotation of arm member 24 in a first direction to engage gate 36 at a first aperture-occluding position (in which position gate 36 is shown in FIGS. 1, 2 and 3). Such first stop means can comprise a pair of pins 40 and 42, disposed downwardly on the bottom of seat base 10 along a line which is substantially parallel to the major axis of elongated aperture 20 so as to engage gate 36 at the first, aperture-occluding, position. Second stop means also are disposed on the bottom of seat base 10 and are operable upon rotation of arm member 24 in a second, opposite, direction to engage gate 36 at a second, fully non-occluding, position (in which position gate 36 is shown in FIG. 4). The second stop means also can be a pair of pins 44 and 46. Alternatively the first and second stop means can be bar or plate affixed to seat base 10 or can be constituted by a downwardly disposed molded portion of the bottom surface of seat base 10.

Because gate 36 is freely rotatable about bearing 38 on end portion 26 of arm 24 except when engaged and positioned by the triangulation of the first stop means and its pivotable mounting, the orientation of gate 36 during passage across aperture 20 of seat base 10 will adjust to any obstruction, anatomically or otherwise, which inadvertently might be present. Moreover, the double bearing arrangement of the pivotable mounting of gate 36 on end portion 26 of arm 24, which in turn is rotatable mounted on seat base 10, permits the gate to pivot as the arm member is rotated and thereby to remain fully under seat base 10 when in its second, non-occluding position (see FIG. 4). In view of the spatial restraints imposed by the relationship of (i) the fixed dimensions of a standard wheelchair and (ii) the necessity for elongated aperture 20 to be of relatively great length (as compared with the depth of a wheelchair seat), this orientation would not be possible if the gate were non-rotatably fixed to the arm member or were itself pivotable mounted directly to the seat base, since in each case the maximum arc defined by the gate upon its movement to a fully non-occluding position would exceed the available space under the seat.

Support means 48 and 50, operable to supportively engage removable waste receptacle 52 (shown in FIGS. 1, 2 and 3 but not in FIG. 4) in a position vertically aligned with and below elongated aperture 20, are fixedly disposed in parallel relationship on seat base 10 on either side of aperture 20. Support means 48 and 50 can comprise a pair of rails 54 and 56 rigidly suspended below seat base 10 beneath all of aperture 20, gate 36, and elongated arm member 24. Alternatively, rails 54 and 56 can be rigidly disposed a distance below seat base 10 with waste receptacle 52 then provided with a pair of parallel, typically tubular, openings (not shown) to receive the rails.

Removable waste receptacle 52 is supportively engaged by support means 48 and 50 so as to be positioned under seat base 10 in alignment with elongated aperture 20 when the seat is positioned on an opened wheelchair frame. Removable waste receptacle 52 will have a generally rectangular entrance aperture of dimensions at least coextensive with but greater than those of elongated aperture 20 and a configuration such as to permit positioning of the receptacle under elongated aperture 20 of seat base 10 within the potentially obstructing elements of a foldable wheelchair frame. In order to accommodate, for example, the pivotably joined cross-braces of a foldable wheelchair frame, receptacle 52 can be stepped in sideview (see FIG. 3), having a first relatively shallow zone 58 (such as to permit insertion within the upper "V" of the "X" of the cross-braces of the wheelchair) and a second zone 60 of a greater depth and volume which normally lies behind the cross-braces. Receptacle 52 can be provided with a pair of parallel lips 62 and 64 (which can extend around the entire receptacle) which ride on support means 48 and 50. A complementing cover (not shown) can be provided for removal purposes.

Locking means 66, operable to retain removable waste receptacle 52 when supportively engaged by support means 48 and 50, can be disposed on the bottom of seat 10. Locking means 66 may be of any design and need be sufficient only to retain waste receptacle 52 in position on support means 48 and 50 until removal is required.

When it is desired to fold the wheelchair, the waste receptacle 52 is withdrawn and seat base 10 and its associated component are removed from the wheelchair frame by simply lifting the entire structure from the frame and then transporting or storing it, as the case may be, with the folded wheelchair frame.

What is claimed is:

1. A wheelchair seat for placement in a foldable wheelchair frame comprising (i) a rigid, substantially flat seat base operable to be received by a wheelchair frame and to support a person thereon in a seated position, said seat base having an elongated aperture defined in said seat base which aperture is coaxial with the major axis of the perineum of a person when normally seated on said seat base, said aperture being of such minimal dimensions as to permit the normally free passage of urinary and fecal excretions through said aperture without detracting from the support provided by said seat base;

(ii) an elongated arm member pivotably mounted on the underside of said seat base for rotation about an axis perpendicular to the major plane of said seat base, a portion of said arm member passing under said aperture;

(iii) an elongated gate of a length and a width sufficient to occlude said aperture, said gate being rotatably mounted at a point on said arm member passing under said aperture;

(iv) first stop means disposed on the bottom of said seat base and operable upon rotation of said arm member in a first direction to engage said gate at a first aperture-occluding position;

(v) second stop means disposed on the bottom of said seat base and operable upon rotation of said arm member in a second, opposite, direction to engage said gate at a second, non-occluding, position; and (vi) support means disposed on said seat base beneath said aperture and said gate and operable to support a removable waste receptacle in a position vertically aligned with said aperture.

2. A wheelchair seat according to claim 1 wherein said elongated arm member comprises a first end portion, a second end portion, and an intermediate collar portion aligned transversely to the major axis of said arm member, said gate being mounted on said first end portion of said arm member and second end portion of said arm member comprising a handle extending beyond said seat base for rotation of said arm member, and further comprising a shaft operable to receive said collar portion disposed on the underside of said seat base, and fastener means removably engaging said shaft and operable when engaging said shaft to retain said arm member on said shaft for rotational movement.

3. A wheelchair seat according to claim 2 wherein said removable waste receptacle support means comprise a pair of rails rigidly disposed on said seat base beneath all of said aperture, said gate, and said first, gate carrying, portion of said elongated arm member, said rails being operable to supportively engage a removable waste receptacle below said elongated aperture.

4. A wheelchair seat according to claim 3 including locking means disposed on the bottom of said seat, said locking means being operable to retain a removable waste receptacle when supportively engaged on said rails.

5. A wheelchair seat according to claim 1 wherein said elongated gate has parallel sides along its longest dimension, has a substantially smooth, readily cleanable, planar upper surface, and is rotatably mounted on said arm member at approximately the midpoint of the lower surface of said gate.

6. A wheelchair seat according to claim 5 wherein said first stop means comprise a pair of pins disposed downwardly on the bottom of said seat base along a line substantially parallel to the major axis of said elongated aperture defined in said seat base and operable to engage said gate at said first, aperture-occluding, position.

7. A wheelchair seat according to claim 1 including frame engaging means operable to retain said seat base on the opened frame of foldable wheelchair.

8. A wheelchair seat for placement in a foldable wheelchair frame when said frame is in its fully open position, which seat comprises (i) a rigid, substantially flat seat base operable to be positioned on an opened wheelchair frame for support of a person in a seated position thereon, said seat base having an elongated aperture defined in said seat base which aperture is coaxial with the major axis of the perineum of a person when normally seated on said seat base, said aperture being of such minimal dimensions as to permit the normally free passage of urinary and fecal excretions through said aperture without substantially detracting from the support provided by said seat base;

(ii) frame engaging means operable to retain said seat base on the opened frame of said foldable wheelchair;

(iii) an elongated arm member pivotably mounted on the underside of said seat base for rotation about an axis perpendicular to the major plane of said seat base, said elongated arm member comprising a first end portion, a second end portion, and an intermediate collar portion aligned transversely to the major axis of said arm member, said second end portion of said arm member comprising a handle extending beyond said seat base for rotation of said arm member;

(iv) a shaft disposed on the underside of said seat base and operable to receive said collar portion of said arm member;

(v) fastener means removably engaging said shaft and operable to retain said arm member on said shaft for rotational movement with said first end portion of said arm member passing under said aperture;

(vi) an elongated gate of a length and a width sufficient to occlude said elongated aperture, said elongated gate having parallel sides along its longest dimension and a substantially smooth, readily cleanable, planar upper surface, and being rotatably mounted at approximately the midpoint of the lower surface of said gate on said first end portion of said arm member at a point passing under said aperture;

(vii) first stop means disposed downwardly on the bottom of said seat base along a line substantially parallel to the major axis of said elongated aperture and operable upon rotation of said arm member in a first direction to engage said gate at a first, aperture-occluding, position;

(viii) second stop means disposed downwardly on the bottom of said seat base and operable upon rotation of said arm member in a second, opposite, direction to engage said gate at a second, non-occluding, position;

(ix) a removable waste receptacle having an entrance aperture of dimensions at least coextensive with those of said elongated aperture and a configuration permitting positioning of the receptacle under said seat base in alignment with said elongated aperture when said seat is positioned on said opened wheelchair frame;

(x) a pair of rails rigidly disposed on said seat base beneath all of said aperture, said gate, and said first end portion of said elongated arm member, said rails being operable to supportively engage said waste receptacle below and in a vertically aligned position with said elongated aperture; and (xi) locking means disposed on the bottom of said seat, said locking means being operable to retain said waste receptacle when supportively engaged on said rails.

* * * * *